US005605501A

United States Patent [19]

Wiand

[11] Patent Number: 5,605,501

[45] Date of Patent: Feb. 25, 1997

[54] LENS SURFACING PAD WITH IMPROVED ATTACHMENT TO TOOL

[76] Inventor: Ronald C. Wiand, 1494 Heatherwood Dr., Troy, Mich. 48098

[21] Appl. No.: 531,924

[22] Filed: Sep. 20, 1995

Related U.S. Application Data

[63] Continuation of Ser. No. 345,254, Nov. 28, 1994, abandoned, which is a continuation of Ser. No. 9,379, Jan. 27, 1993, abandoned, which is a continuation of Ser. No. 767,521, Sep. 25, 1991, abandoned, which is a continuation of Ser. No. 511,460, Apr. 20, 1990, abandoned, which is a continuation-in-part of Ser. No. 418,933, Oct. 6, 1989, abandoned, which is a continuation of Ser. No. 323,233, Mar. 13, 1989, abandoned, which is a continuation of Ser. No. 183,525, Apr. 19, 1988, abandoned, which is a continuation of Ser. No. 904,899, Sep. 8, 1986, abandoned.

[51] Int. Cl.[6] ..... B24D 11/00

[52] U.S. Cl. ..... 451/526; 451/539; 451/538; 451/921

[58] Field of Search ..... 451/490, 525, 451/526, 538, 539, 533, 921

[56] References Cited

U.S. PATENT DOCUMENTS

| | | | |
|---|---|---|---|
| 1,487,024 | 3/1924 | Robinson . | |
| 2,991,596 | 7/1961 | Walters . | |
| 3,144,737 | 9/1962 | Faas | 451/538 |
| 3,436,875 | 4/1969 | Cheney | 51/376 |
| 3,527,001 | 9/1970 | Kleemeier et al. . | |
| 3,823,516 | 7/1974 | Christian | 51/358 |
| 4,263,755 | 4/1981 | Globus . | |
| 4,274,232 | 6/1981 | Wylde | 51/358 |
| 4,609,581 | 9/1986 | Ott . | |

FOREIGN PATENT DOCUMENTS

| | | |
|---|---|---|
| 964961 | 7/1964 | United Kingdom . |
| 1420450 | 5/1978 | United Kingdom . |

*Primary Examiner*—Bruce M. Kisliuk
*Assistant Examiner*—Dona C. Edwards
*Attorney, Agent, or Firm*—Harness, Dickey & Pierce P.L.C.

[57] ABSTRACT

A surfacing pad adapted for use with a lapping tool has a substrate sheet having a plurality of mushroom-shaped projections which interlock with a number of loops on a lapping tool for retention of the pad on the tool. A segmented projection means is also provided.

3 Claims, 4 Drawing Sheets

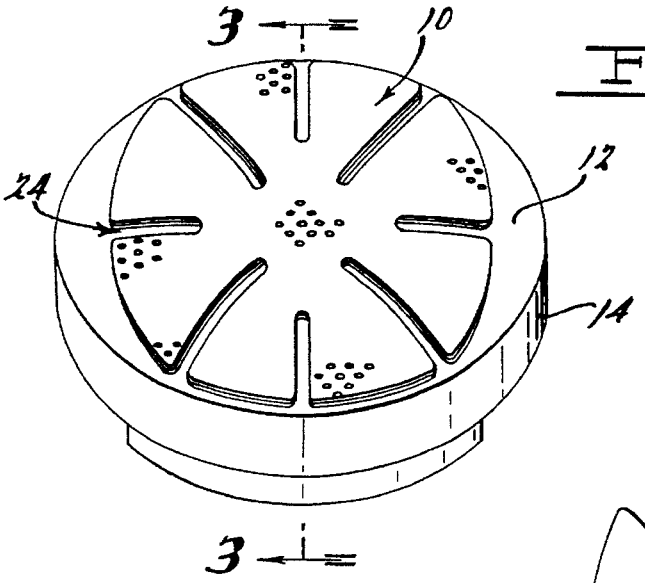
FIG. 1.
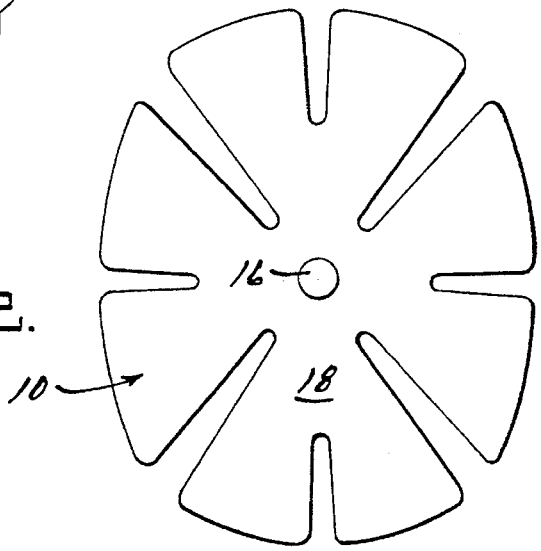
FIG. 2.
FIG. 3.
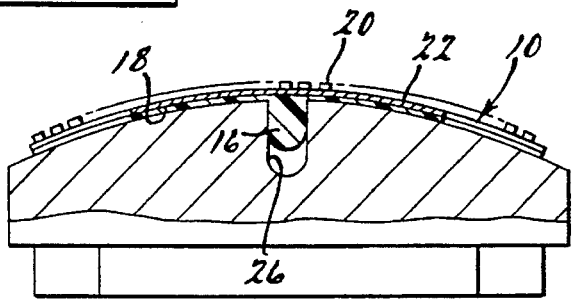
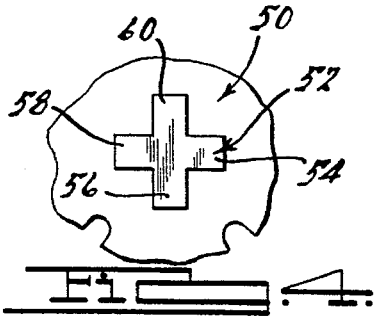
FIG. 4.
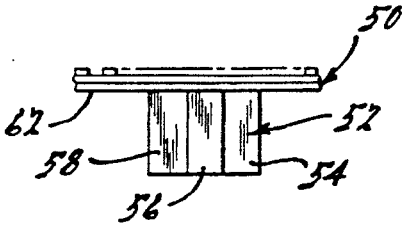
FIG. 5.

LENS SURFACING PAD WITH IMPROVED ATTACHMENT TO TOOL

This is a continuation of U.S. patent application Ser. No. 08/345,254, filed Nov. 28, 1994 now abandoned, which is a continuation of Ser. No. 08/009,379, filed Jan. 27, 1993, now abandoned, which is a continuation of Ser. No. 07/767,521, filed Sep. 25, 1991, now abandoned, which is a continuation of Ser. No. 07/511,460, filed Apr. 20, 1990, now abandoned, which is a continuation-in-part of Ser. No. 07/418,933, filed Oct. 6, 1989, now abandoned, which a continuation of Ser. No. 07/323,233, filed Mar. 13, 1989, now abandoned, which is a continuation of Ser. No. 07/183,525, filed Apr. 19, 1988, now abandoned, which is a continuation of Ser. No. 06/904,899, filed Sep. 8, 1986, now abandoned, all having the same title: LENS SURFACING PAD WITH IMPROVED ATTACHMENT TO TOOL.

BACKGROUND OF THE INVENTION

The present invention relates to grinding and polishing pads and, in particular, to grinding and polishing pads used in conjunction with lens lapping tools for grinding and polishing optical and ophthalmic lenses. More specifically, the present invention relates to an improvement in the means by which ophthalmic lens surfacing pads are attached to lens lapping tools.

Optical and ophthalmic lenses are generally made by generating a lens blank to the desired curvature on a curve generator and then lapping the lens by means of an abrasive slurry and an oscillating lapping tool. Lapping tools are usually cast iron or aluminum tools having various lapping surfaces, each of a curvature corresponding to a desired lens curvature. Thus, an optical manufacturer requires a set of lapping tools in order to manufacture lenses of various prescriptions.

Lapping pads which conform exactly to the lapping tool curvature are generally used on the surface of each lapping tool. Lapping pads, sometimes referred to as surfacing pads, usually wear relatively quickly and are replaced after several lenses are ground. But lapping pads provide a relatively inexpensive surface which will wear instead of the relatively expensive lapping tool.

Recently, improved lapping pads have been developed which contain lapping abrasive on the surface of the pad or impregnated into it. One lapping procedure using such pads involves adhesively attaching a first fining sandpaper pad to a lapping tool and fine grinding a lens under running water to the proper curve. Then, a second fining pad of smaller grit than the first pad is placed over and adhered to the first pad and the lens is subjected to a second fining step under running water. Next, both pads are removed from the lapping tool, a flocked polishing pad is adhered to the tool and the lens is polished to a clear finish under a polishing slurry.

The aforementioned lapping procedure can be used for glass and plastic lenses. However, the procedure has certain disadvantages. An operator must frequently attach and remove the pads of which are adhesively secured either to the surface of the lapping tool or to a pad on the surface of the tool and can be difficult to peel off the tool. Furthermore, the pads can be difficult to attach to the tools without wrinkles, which adversely effect the performance of the pad. Coolant water flowing over the pads serves to further increase the difficulties encountered in attaching and removing the pads. The present invention provides an improved lens surfacing pad and method which reduces these difficulties. Further understanding of this invention will be had from the following description and accompanying drawings.

SUMMARY OF THE INVENTION

The present invention relates to a surfacing pad adapted for use with a lapping tool, the surfacing pad having a substrate sheet and mechanical retention means for retaining the pad in position on the tool. The retention means preferably comprises a projection extending generally transversely from the surfacing pad and sized to closely interfit in an associated recession in a lapping tool. In one embodiment the projection is a plurality of projections, each having a mushroom shape which interlocks with associated loops. In another embodiment an improved projection means is provided which is segmented to provide a better conforming surface on the finishing pad at the location of the projection portion.

BRIEF DESCRIPTION OF THE DRAWINGS

FIG. 1 is a perspective of a lens surfacing pad of the present invention shown in operative association with a lens lapping tool;

FIG. 2 is a bottom view of a lens surfacing pad of the present invention;

FIG. 3 is a sectional view taken along line 3—3 in FIG. 1;

FIG. 4 is a bottom view, broken away, of an alternative embodiment of the present invention;

FIG. 5 is a side view, broken away, of the alternative embodiment of the present invention as shown in FIG. 4;

DESCRIPTION OF THE INVENTION

Figure 6:
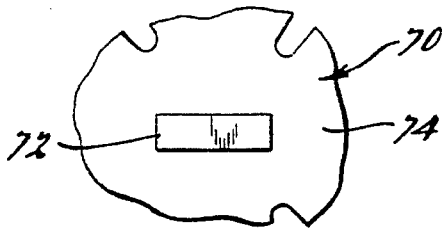
FIG. 6 is a bottom view, broken away, of another alternative embodiment of the present invention.

Now referring to the drawings, FIG. 1 illustrates a lens surfacing pad 10 of the present invention shown in operative position on surface 12 of lens lapping tool 14. As will be appreciated by those skilled in the art, in use, a blocked lens will be oscillated over pad 10 mounted upon lens lapping tool 14 in a grinding or polishing operation. Surface 12 of lens lapping tool 14 has a shape corresponding to the curvature desired for a lens. Conventionally, lens surfacing pads are adhesively secured to the curved surface of lens lapping tools. In accordance with the present invention, however, lens surfacing pad 10 is provided with mechanical retention means 16 for securing lens surfacing pad 10 in position on surface 12 of lens lapping tool 14.

As is best illustrated in FIG. 3, lens surfacing pad 10 comprises a polyester substrate sheet 18 which carries a plurality of diamond grit particles 20 which are secured onto sheet 18 by metal matrix layer 22. To facilitate close adherence to the surface 12 of lens lapping tool 14, lens surfacing pad 10 has a plurality of generally radially extending slots 24 therein.

Substrate sheet 18 can alternatively be made of any flexible sheet material suitable for its intended uses. For example, substrate sheet 18 can be metal, such as copper, aluminum or steel, or polyester, polypropylene, polyethylene or other polymeric material. Suitable substrate sheet thicknesses can vary widely. For example, sheet thicknesses of from 1/1000 inch to 1/16 inch can be suitable. Substrate sheet 18 can comprise one or multiple layers. A preferred substrate sheet is aluminum metallized polyester.

Substrate sheet 18 carries abrasive grit particles 20 bonded thereto by a suitable bonding layer 22 which is preferably a metal matrix when diamond abrasive particles are used. Suitable metals or metal matrixes and methods of plating metal to bond diamond grit to substrate sheets are well known in the art. Suitable metals include nickel and its alloys and plating methods include electroplating, chemical reduction and vacuum metal deposition.

Suitable abrasive particles will, of course, vary with the intended use of the pad. For example, aluminum oxide, silicon carbide or other grit particles can be used and conventionally bonded to a carrier substrate. However, diamond particles, suitably from 10 microns to 100 microns in diameter, are preferred because of their longer life in use.

In accordance with the present invention, lens surfacing pad 10 has a mechanical retention means 16 for retaining the pad in position on lapping tool 14. As illustrated in FIGS. 2 and 3, retention means 16 is shown as a projection, generally cylindrical in shape, which extends generally transversely to the general plane of substrate 18 and extends downwardly into a correspondingly shaped recess 26 in the body of lens lapping tool 14. Thus, it will be appreciated by those skilled in the art that in use, while a lens is being surfaced, the pressure of the lens against the pad will retain retention means 16 in recess 26 and hence will retain lens surfacing pad 10 on lens lapping tool 14.

FIGS. 4 through 19 show various alternative retention means for retaining lens surfacing pad 10 on a lens lapping tool 14. Thus, FIGS. 4 and 5 show a lens surfacing pad 50 of construction generally analogous to lens surfacing pad 10 but having retention means 52 generally in the shape of a cross. Thus, retention means 52 has four legs 54, 56, 58 and 60, which extend generally downwardly from substrate 62 of lens surfacing pad 50. As will be appreciated by those skilled in the art, retention means 52 is adapted to closely interfit into a corresponding recession in lens surfacing tool 14. Because of the shape of retention means 52, lens surfacing pad 50 will be retained on the surface of lens lapping tool 14 with no rotation thereof.

Figure 7:
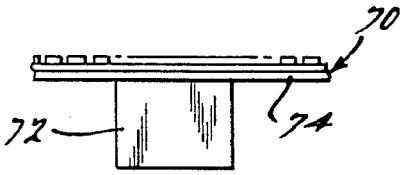
FIG. 7 is a side view, broken away, of the alternative embodiment of the present invention shown in FIG. 6.

FIGS. 6 and 7 illustrate yet another alternative embodiment of the present invention. Thus, lens surfacing pad 70 has a retention means 72 in the form of a ridge extending downwardly from substrate 74 of lens surfacing pad 70. Retention means 72 is adapted to closely fit into a corresponding recess in a lens surfacing tool, and once interfit therein, to provide means for positioning and retaining lens surfacing pad 70 on the lens lapping tool.

Figure 8:
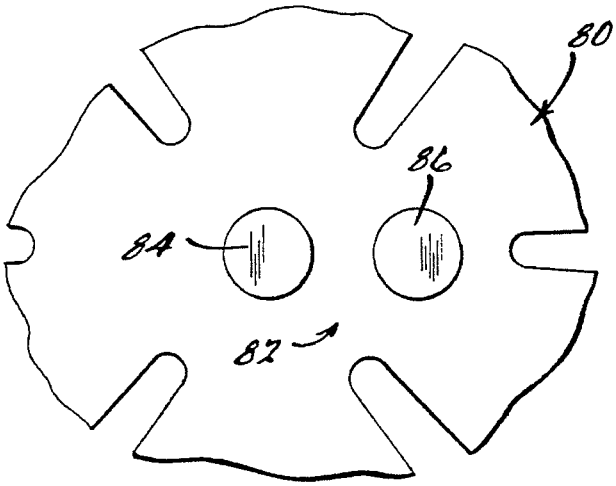
FIG. 8 is a bottom view, broken away, of another alternative embodiment of the present invention.
Figure 9:
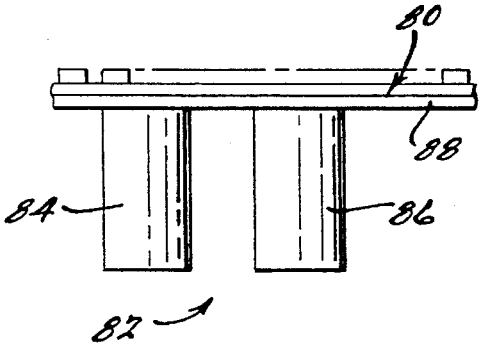
FIG. 9 is a side view, broken away, of the alternative embodiment of the present invention shown in FIG. 8.

Now referring to FIGS. 8 and 9 still another alternative embodiment of the present invention is shown. Thus, lens surfacing pad 80 has retention means 82 comprising a pair of generally cylindrically shaped projections 84 and 86 extending downwardly from substrate 88 of lens surfacing pad 80. Projection 80 can be positioned, for example, in the center of lens surfacing pad 80 and projection 86 positioned off center to facilitate placement of the pad onto a lens surfacing tool and to prevent rotation of the pad on the tool once in place thereon.

Figure 10:
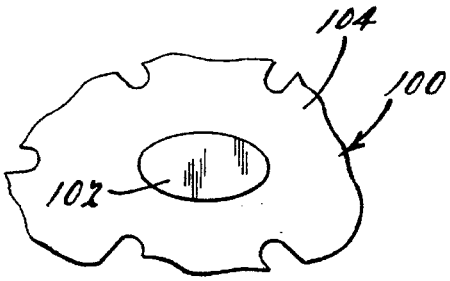
FIG. 10 is a bottom view, broken away, of another alternative embodiment of the present invention.
Figure 11:
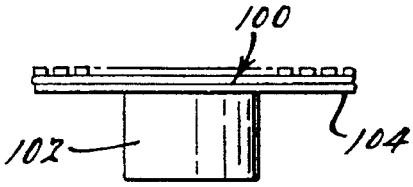
FIG. 11 is a side view, broken away, of the alternative embodiment of the present invention shown in FIG. 10.

Still another alternative embodiment is illustrated in FIGS. 10 and 11 and indicated generally by the numeral 100. Lens surfacing pad 100 has a retention means 102 extending downwardly from substrate 104 of lens surfacing pad 100. Retention means 102 is generally elliptical in shape when viewed in bottom view as illustrated in FIG. 10. Thus, when retention means 102 is closely interfit into a correspondingly shaped recess in the lens lapping tool, rotation of lens surfacing pad 100 will be prevented.

Figure 12:
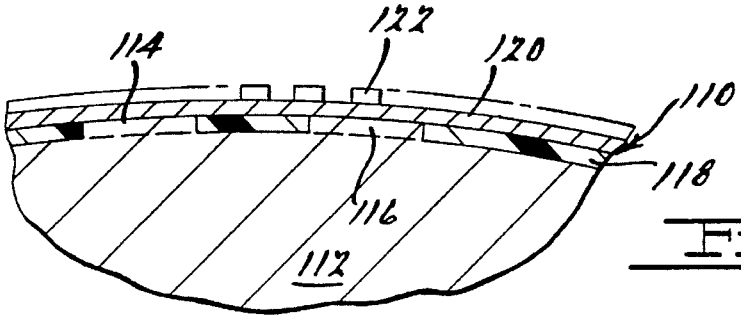
FIG. 12 is a sectional view similar to that of FIG. 3, broken away, showing another alternative embodiment of the present invention.

FIG. 12 illustrates another alternative embodiment indicated generally by the numeral 110. Lens surfacing pad 110 is shown positioned on lens lapping tool 112. Lens lapping tool 112 has a pair of projecting portions 114 and 116 which extend partially into corresponding recesses in substrate 118 of lens surfacing pad 110. Lens surfacing pad 110 also includes a metallic layer 120 having abrasive particles 122 attached thereon in a conventional manner.

Figure 13:
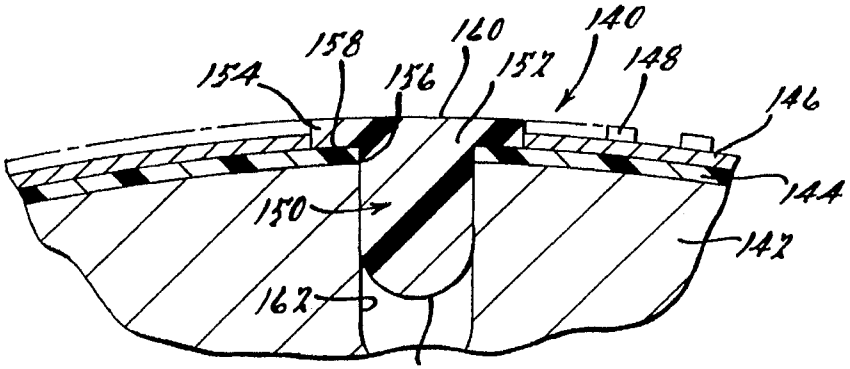
FIG. 13 is a sectional view similar to that of FIG. 3, broken away, showing another alternative embodiment of the present invention.

Now referring to FIG. 13, a lens surfacing pad 140 is shown in retained position on lens lapping tool 142. Lens surfacing pad 140 has a substrate sheet 144 with metal layer 146 securing abrasive grit 148 thereon. Lens surfacing pad 140 has discrete retention means 150; that is, retention means 150 is separate from and removable from lens surfacing pad 140. Retention means 150 comprises a cylindrical portion 152 with rounded end 153 and annular flange 154. Cylindrical portion 152 of retention means 150 extends through aperture 156 in substrate 144 while annular flange 154 has a diameter greater than aperture 156 and abuts against the outwardly facing surface 158 of substrate 144. Outwardly facing surface 160 of retention means 150 lies on the lapping surface of surfacing pad 140 as shown in the figure, or alternatively lies below the surface inwardly at the general outward plane of grit 148 so as not to interfere with the abrasive action thereof. Thus, retention means 150 when fit into correspondingly shaped hole 162 in lapping tool 142 serves to retain lens surfacing pad 140 in position on lens lapping tool 142.

In accordance with the embodiment of the present invention shown in FIG. 13, it will be appreciated that retention means 150 is a plug-like structure which can be manually inserted through aperture 156 in substrate 144 and into hole 162 in lapping tool 142 to retain pad 140 thereon. Thus, retention means 150 can be manufactured separately from pads 140 and combined therewith in this novel manner of the present invention by the end user.

Figure 14:
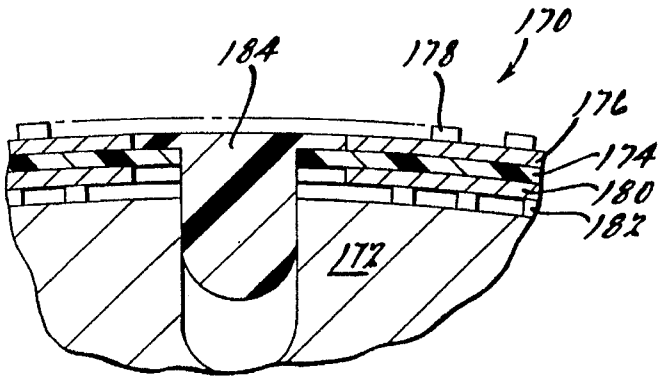
FIG. 14 is a sectional view similar to that of FIG. 3, broken away, showing another alternative embodiment of the present invention.

Furthermore, where discrete retention means 150 are employed, a still further alternative embodiment of the present invention can be obtained. Thus, as shown in FIG. 14, a lens surfacing pad 170 is shown on lens lapping tool 172. Lens surfacing pad 170 has a substrate layer 174 with abrasive surfaces on both sides thereof. Thus, one side of substrate layer 174 has a first metal layer 176 securing relatively fine abrasive grit 178 thereon and the other side of substrate layer 174 has a second metal layer 180 securing very fine abrasive grit 182 thereon.

Retention means 184 is of a construction analogous to retention means 150. Thus, surfacing pad 170 can be used either with fine abrasive grit 178 facing outwardly or with very fine abrasive grit 182 facing outwardly. Retention means 150 can be used to secure surfacing pad 170 in either position. Furthermore, in either position, the abrasive grit adjacent the surface of lapping tool 172 will provide a surface with a high coefficient of friction which will resist rotational movement of pad 170 with respect to tool 172. It will, of course, be appreciated that, if desired, an abrasive layer, or other layer with a high coefficient of friction, on the side of the surfacing pad facing the lapping tool surface can be incorporated into each of the aforementioned embodiments of the present invention. Such a layer would provide additional retention of pads on the lapping tool surfaces.

Figure 15:
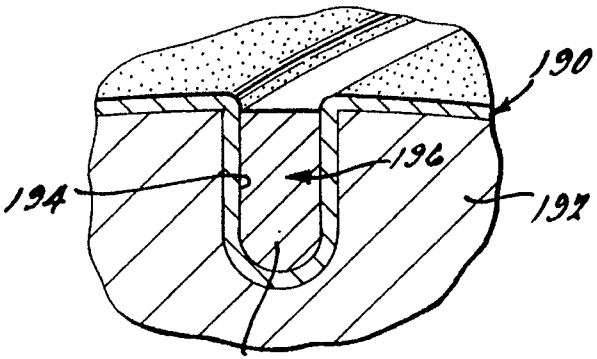
FIG. 15 is an exploded view illustrating still another alternative embodiment of the present invention.

Referring to FIG. 15, still another alternative embodiment of the present invention is illustrated and indicated generally by the numeral 190. Subfacing pad 190 is shown in retained position on lens lapping tool 192. Surfacing pad 190 is illustrated as a one layer sheet without abrasive, however, it will be appreciated that surfacing pad 190 can alternatively comprise a laminate construction with or without abrasive depending upon its intended use. Lens lapping tool 192 has a channel-like keyway 194. Surfacing pad 190 includes retention means 196 which includes an elongated key 198 which is sized for interference fit with pad 190 in corresponding elongated keyway 194 to retain pad 190 in position on lens lapping tool 192.

Figure 16:
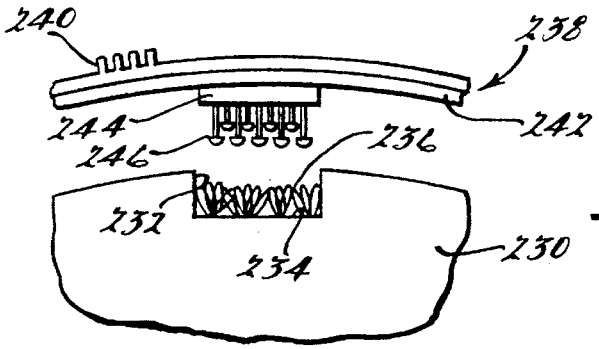
FIG. 16 is a side view, broken away, of an alternative embodiment of the present invention.
Figure 17:
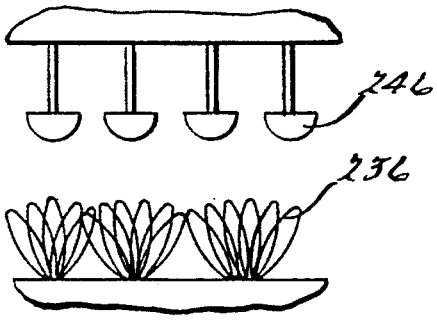
FIG. 17 is an exploded view of the embodiment of FIG. 16.

Referring to FIGS. 16 and 17, still another alternative embodiment of the present invention is illustrated. Lapping tool 230 is shown having a recess 232. Within recess 232 a layer of material 234, such as nylon plastic, is secured by known means, such as an adhesive. Secured to layer 234 is a layer of cloth representing a layer of loops 236. Surfacing pad 238 has the usual layer of grit material 240 on the outside and a substrate 242 on the inside. Affixed to the substrate 242 is a section of material 244, such as a nylon plastic, smaller than the recess and having a series of mushroom shaped hooks 246. When the pad 238 is placed on the tool 230, the hooks engage the loops to secure the pad to the tool. A close-up view of the mushroom shaped hooks and the loops can be seen in FIG. 17.

Preferably, the recess 232 should be greater than 7 square millimeters and no deeper than two times the projection length of the mushroom-shaped hooks. The recess should be no greater than 160 square millimeters and no deeper than two times the length of the mushroom shaped hooks. The recess is preferably round, but can take on any number of shapes. The mushroom hooks can be injection molded for very exacting tolerances. It is possible to cover the entire inner surface of the pad with the mushroom-shaped hooks and the entire surface of the lapping tool with the layer of loops. Furthermore, the hooks can be secured to the lapping tool and the loops to the pad.

Figure 20:
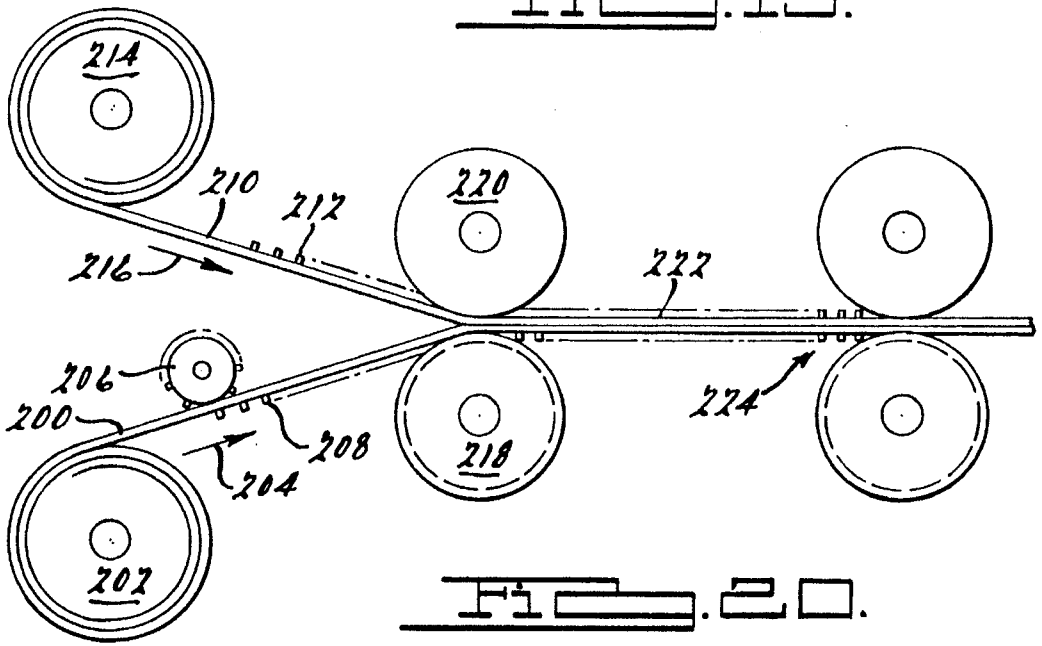
FIG. 20 is a somewhat schematic view illustrating a method of making a lens surfacing pad of the present invention.

Now referring to FIG. 20, a method for making lens surfacing pads of the present invention is illustrated in schematic form.

Substrate sheet 200 is unwound from roller 202 in direction indicated by arrow 204 and passes over thermoforming roller 206 which provides projections 208 in substrate sheet 200. Projections 208 provide means for retaining the final lens surfacing pad product on a lens lapping tool as herein above described. Metal sheet 210 carrying abrasives 212 is unwound from roller 214 in the direction indicated by arrow 216. Substrate sheet 200 and metal sheet 210 are compressed between heated rollers 218 and 220 which serve to bond the respective sheets together. The bonded laminate 222 is then passed between a rotary die cutter 224 which cuts individual lens surfacing pads from laminate 222.

Figure 18:
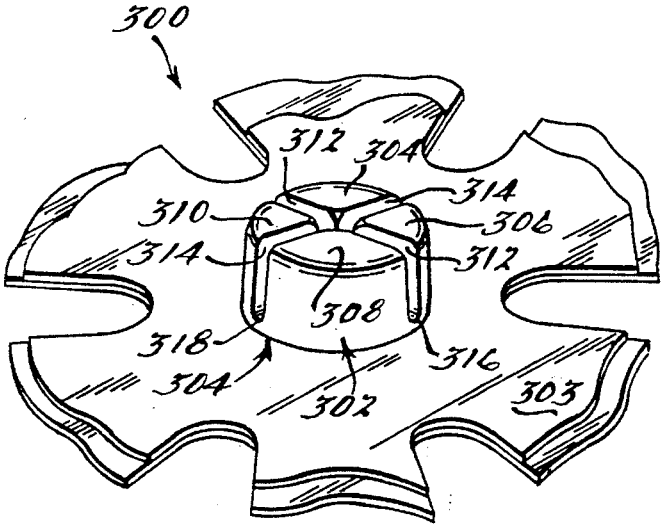
FIG. 18 is a perspective view of a further alternative embodiment of the present invention.
Figure 19:
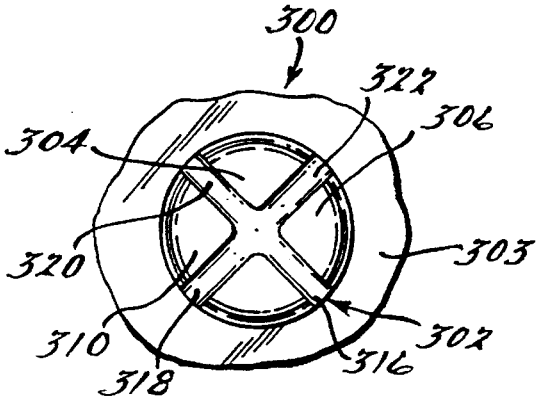
FIG. 19 is a plan view of the embodiment of FIG. 18.

Referring to FIGS. 18 and 19, still another alternate embodiment of the present invention is illustrated and indicated generally by numeral 300. Surfacing pad 300 includes retention means 302 connected to a surfacing pad 303. The retention means 302 in this embodiment differs from the prior embodiments in that it is segmented to provide better tool and lens conforming capabilities when the surfacing pad is utilized on a lens lapping tool. The retention means 302 includes at least a pair of segmented portions which are separated by a channel in the member 302 and connected at their base by a hinge-like member 304. The member 302, as shown in the drawings, preferably includes four segments 304, 306, 308 and 310 connected by hinge-like members 316, 318, 320 and 322. A pair of diametrical channels 312 and 314 separate the retention means 302 in the four segments as shown. In a preferred configuration of the present invention the channels may be 0.010 inches wide and are utilized in a 0.247 inch diameter 0.150 inch high injection molded polycarbonate projection 302.

Thus, in accordance with this embodiment of the present invention the grooves 312 and 314 allow space between the segments for allowing the segments to move with respect to one another as the lapping tool progresses over a curved surface. This flexibility of the projection allows the working surface of the pad underlying the projection to conform better to the tool and the lens during a lens polishing operation.

In operation the segments 304, 306, 308 and 310 are hingedly movable about hinges 316, 318, 320 and 322 with respect to one another. Preferably, the segments move toward one another. This provides an underlying cone-like configuration (pyrimidal in the illustrated embodiment) on the pad surface. Such a cone-like configuration provides improved finish results, particularly in very strong lens prescriptions. Thus, better surface following characteristics to the surfacing pad are provided by this embodiment of the present invention.

It will be appreciated that lens surfacing pads of the present invention can be made by other methods. For example, retention means can be individually manually adhered to suitable pads with adhesive. The embodiments of FIGS. 13–15 employ discrete retention means which are not permanently attached to surfacing pads and, hence, would be made separate therefrom.

While the foregoing disclosure sets forth several preferred embodiments of the present invention, it will be readily apparent to those skilled in the art that the present invention may be subject to modification and variation from the specific embodiments disclosed. Accordingly, it is intended that the scope of the present invention be limited only by the following claims.

What is claimed is:

1. A surfacing pad for use on a curved surface of a lapping tool having an aperture which extends below said curved surface, comprising:

a substrate sheet having an overall annular shape with radially extending slots to allow said pad to conform precisely to the curved surface of the lapping tool and projection means extending from said pad, said projection extending transverse to the pad, said projection adapted to couple with the aperture in the lapping tool;

said projection means having an open center with radially outwardly extending channels, said channels extending longitudinally the length of said projection to thereby provide at least a pair of spaced segments hingedly connected at a first end adjacent the substrate sheet for forming a hinge means, said hinge means for enabling radially inward movability of the segments when inserted into the aperture, such that the segments are hingedly movable with respect to one another for enabling conformance of the underlying surfacing pad to the curved surface of the lapping tool at the projection means location.

2. The surfacing pad of claim 1 wherein said projection means are separated from one another by diametrical channels.

3. The surfacing pad of claim 2 wherein said projection means further comprises four segmented portions.

* * * * *